US011707777B2

(12) United States Patent
Mokre et al.

(10) Patent No.: US 11,707,777 B2
(45) Date of Patent: Jul. 25, 2023

(54) METHOD FOR PREPARING A FOUNDRY SAND MIXTURE

(71) Applicant: Nemak, S.A.B. de C.V., Garcia (MX)

(72) Inventors: Alexander Mokre, Linz (AT); Mark Ensinger, St. Florian (AT); Walter Hartl, Weiten (AT); Viktoria Dargai, Saly (HU); Bettina Ritt, Sierning (AT)

(73) Assignee: Nemak, S.A.B. de C.V., Nuevo Leon (MX)

( * ) Notice: Subject to any disclaimer, the term of this patent is extended or adjusted under 35 U.S.C. 154(b) by 0 days.

(21) Appl. No.: 17/256,280

(22) PCT Filed: Jul. 1, 2019

(86) PCT No.: PCT/IB2019/055584

§ 371 (c)(1),
(2) Date: Dec. 28, 2020

(87) PCT Pub. No.: WO2020/003277

PCT Pub. Date: Jan. 2, 2020

(65) Prior Publication Data

US 2021/0260647 A1 Aug. 26, 2021

(30) Foreign Application Priority Data

Jun. 29, 2018 (EP) ..... 18180868

(51) Int. Cl.
*B22C 5/04* (2006.01)
*B22C 5/10* (2006.01)
*B22C 5/18* (2006.01)

(52) U.S. Cl.
CPC ..... *B22C 5/185* (2013.01); *B22C 5/0463* (2013.01); *B22C 5/0472* (2013.01); *B22C 5/10* (2013.01)

(58) Field of Classification Search
CPC ..... B22C 5/04; B22C 5/0463; B22C 5/0472; B22C 5/10; B22C 5/18; B22C 5/185; B22C 5/0409
(Continued)

(56) References Cited

U.S. PATENT DOCUMENTS 5,279,741 A 1/1994 Schott
9,737,927 B2 8/2017 Koch et al.

FOREIGN PATENT DOCUMENTS

CN 101209485 A 7/2008
CN 103056291 A 4/2013
(Continued)

OTHER PUBLICATIONS

Machine translation of DE 10 2005 041 519 A1 (Year: 2007).*
(Continued)

*Primary Examiner* — Kevin P Kerns
(74) *Attorney, Agent, or Firm* — The Webb Law Firm

(57) ABSTRACT

A method for recovery of moulding sand from a foundry sand mixture, which includes at least one proportion of moulding material fragments or loose moulding material grains, which accumulates when a cast part is demoulded from a casting mould as a result of the destruction of casting cores which have been formed from the moulding sand and an inorganic binder. The method includes: a) mixing the foundry sand mixture with cleaning water to form a slurry in order to dissolve the inorganic binder residues contained in the foundry sand mixture and optionally present additives from the moulding sand and to rinse them from the foundry sand mixture, and b) separating the cleaning water contaminated with the inorganic binder residues from the moulding sand contained in the slurry, wherein the process temperature of the slurry formed in step a) is 50 to 200° C.

14 Claims, 1 Drawing Sheet

(58) Field of Classification Search
USPC ..... 164/456, 5, 412
See application file for complete search history.

(56) References Cited

FOREIGN PATENT DOCUMENTS

| | | | |
|---|---|---|---|
| CN | 103394638 | A | 11/2013 |
| CN | 104759584 | A | 7/2015 |
| DE | 4109167 | A1 | 9/1991 |
| DE | 10200504519 | A1 | 3/2007 |
| DE | 102012011384 | A1 | 12/2013 |
| EP | 0446402 | A1 | 9/1991 |
| JP | S5299924 | A | 8/1977 |
| JP | H03238141 | A | 10/1991 |
| JP | 2002178100 | A | 6/2002 |
| JP | 2011088125 | A | 5/2011 |
| RU | 2496599 | C2 | 3/2011 |
| SU | 910309 | | 3/1982 |
| SU | 921664 | | 4/1982 |
| WO | 8503462 | A1 | 8/1985 |
| WO | 2007082747 | A1 | 7/2007 |

OTHER PUBLICATIONS

Baumbach, "Erarbeitung einer umweltverfahrenstechnischen Konzeption zur NaB-Reinigung von GieBereialtsand des sogenannten Wasserglas-Verfahrens", Sep. 16, 2002, pp. 1-120—Statement of Relevance attached.

Bownes et al., "The SCRATA Wet Reclamation Process for Sodium Silicate Bonded Sands", Proceedings of 1984 Annual Conference, 1984, pp. 1-7, vol. 3:1.

"Sinnerscher Kreis", Wikipedia, Nov. 2021, pp. 1-2, https://de.wikipedia.org/w/index.php?title=Sinnerscher_Kreis&oldid=217405027.

Ammerdick et al., Lehrbuch der Chemie (Textbook of Chemistry), 1972, pp. 108 and 120.

Bosnjakovic et al., Maschinenbau Grundlagen (Mechanical Engineering Basics), 1971, pp. 400 and 401.

Czichos, Die Grundlagen der Ingenieurwissenschaften (The Basics of Engineering), 1991, p. C38.

Schulerduden Chemie (Student Dictionary—Chemistry), 6th ed., 2007, pp. 376 and 377.

* cited by examiner

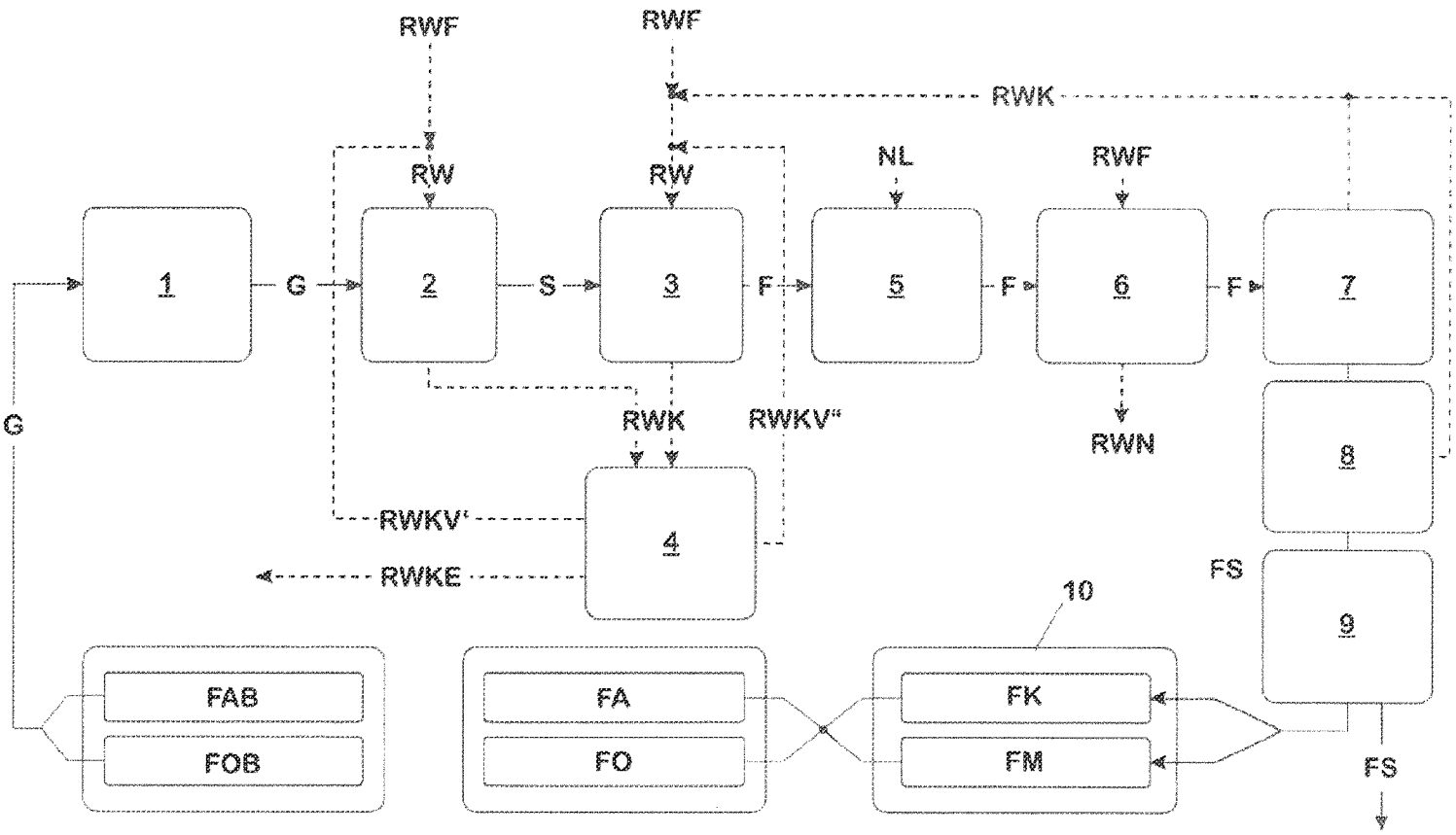
1
2
3
4
5
6
7
8
9
10
G
S
F
RWF
RW
RWK
RWKV'
RWKV''
RWKE
NL
RWM
FS
FAB
FOB
FA
FO
FK
FM

METHOD FOR PREPARING A FOUNDRY SAND MIXTURE

CROSS-REFERENCE TO RELATED APPLICATIONS

This application is the United States national phase of International Application No. PCT/IB2019/055584 filed Jul. 1, 2019, and claims priority to European Patent Application No. 18180868.4 filed Jun. 29, 2018, the disclosures of which are hereby incorporated by reference in their entirety.

BACKGROUND OF THE INVENTION

Field of the Invention

The invention relates to a method for recovering moulding sand from a foundry sand mixture, which comprises at least one proportion of moulding material fragments or loose moulding material grains, which accumulates when a cast part is demoulded from a casting mould as a result of the destruction of casting cores or moulded parts representing the cast part which have been formed from the moulding sand (F) and an inorganic binder and optionally one or a plurality of additives to set the properties of the moulding material. In the case of this method, the foundry sand mixture is mixed with cleaning water to form a slurry, in order to dissolve the inorganic binder residues contained in the foundry sand mixture and optionally present additives from the moulding sand and to rinse it out of the foundry sand mixture. Then, the cleaning water contaminated with the inorganic binder residues is separated from the moulding sand contained in the slurry.

Description of Related Art

A method of this type is for example known from WO 2007/082747 A1, in which this method is in particular suitable for preparing foundry sand mixtures, in which an inorganic binder, in particular a water glass binder, is present. In the case of the known method, in a first step, the casting cores or moulded parts, which accumulate when a cast part is demoulded from a so-called "lost" mould, i.e. a mould destroyed upon demoulding, are mechanically crushed. From the crushed fragments, a suspension is formed by adding water. A separation of the constituents of the suspension follows this. A new ready-to-use core or moulding sand mixture is prepared from the moulding sand obtained upon separation. The initial crushing of the core and moulded part fragments should serve to separate as far as possible, from the moulding sand grains, impurities, which adhere to the moulding sand grains, from which the cores and moulded parts in question were formed. By subsequently supplying water to the thus crushed fragments, the impurities contained should be removed and the individual constituents of the mixture supplied to their respectively intended further processes.

Against the background of the prior art explained below, the object emerges to indicate a method by means of which preparation of foundry sand mixtures of the type indicated in the introduction can be carried out for further use in a cost-effective, resource-saving manner and with increased productivity.

SUMMARY OF THE INVENTION

The method according to the invention serves to recover moulding sand from a foundry sand mixture, which comprises at least one proportion of moulding material fragments or loose moulding material grains, which accumulates when a cast part is demoulded from a casting mould as a result of the destruction of casting cores or moulded parts representing the cast part, which have been formed from the moulding sand and an inorganic binder and optionally one or a plurality of additives for setting the properties of the moulding material, in which the method includes the work steps:

a) mixing the foundry sand mixture with cleaning water to form a slurry in order to dissolve the inorganic binder residues and optionally present additives contained in the foundry sand mixture from the moulding sand and to rinse them out of the foundry sand mixture, and b) separating the cleaning water contaminated with the inorganic binder residues from the moulding sand contained in the slurry.

According to the invention, the process temperature of the slurry formed from the cleaning water and the foundry sand mixture is now 50 to 200° C. in work step a).

It has surprisingly been shown that the inorganic binder contained in a foundry sand mixture to be prepared according to the invention can be dissolved largely in full in the cleaning water supplied by setting a process temperature that is notably higher compared to the room temperature. This effect is used according to the findings underlying the invention when the process temperature of the slurry in work step a) is at least 50° C., with a process temperature of at least 70° C., in particular at least 80° C. particularly favourably affecting the productivity and completeness of the removal of the inorganic binder from the moulding sand in practice. Temperatures of up to 120° C., in particular up to 100° C. have proven particularly advantageous in this case in regard to the required energy usage and the requirements, which must be fulfilled by the required system technology.

The temperature window predefined by the invention is in this case set such that the preparation of the foundry sand mixture can be incorporated into a water and energy-saving circuit.

The invention in this case allows the process temperature and the process times to be matched to one another so that an effective preparation of the accumulating foundry sand is possible with minimal costs. Practical tests have shown that with process temperatures, which are in a temperature window of 80-100° C., the separation of the moulding sand from the inorganic binder can take place in particularly short process times. Thus, the mixing of the foundry sand mixture with the cleaning water thereby forming a slurry and associated dissolving and rinsing of the inorganic binder residues (work step a) of the method according to the invention) can typically be completed within 5 min-60 mins.

It may also be expedient in the case of the method according to the invention to mechanically crush the moulding material fragments contained in the foundry sand mixture prior to mixing with the cleaning water in a crushing apparatus. However, this crushing does not primarily serve to separate binder residues from the moulding sand grains, but rather to increase as far as possible the contact surface for the cleaning water in order to accelerate the dissolution of the binder when mixing the foundry sand mixture with the cleaning water.

In the event that the foundry sand mixture provided for preparation according to the invention contains largely coarse fragments, it may be advantageous for accelerating the development of a slurry intended in work step a) to mechanically separate into grains the moulding material fragments contained in the foundry sand mixture prior to mixing with cleaning water (work step a)). All apparatuses known for this purpose from the prior art, such as for example a clod crusher or the like, are suitable for mechanically crushing the foundry sand mixture.

In particular when exhaust heat is available from another process phase of the method according to the invention or from a process used in the factory in which the process according to the invention is also used, remains otherwise unused, it may be expedient in regard to minimising the effort, which is required for the tempering intended according to the invention, to pre-heat the foundry sand mixture prior to mixing with the cleaning water. In this way, the heating apparatuses provided for heating the cleaning water or the slurry to the respective process temperature can be designed for small outputs and accordingly can achieve and be operated at low costs.

Thus, for example the contaminated cleaning water originating from work step b) can be used to heat the fresh water. To this end, the contaminated cleaning water can be channelled through a heat exchanger, in which heat is transferred from the contaminated cleaning water to fresh cleaning water without this resulting in the mixing of contaminated and fresh cleaning water.

Depending on the degree of soiling of the contaminated cleaning water, it is also possible to use the contaminated water for recirculation in work step a). This reuse can for example be repeated until the solubility of the binder in the contaminated water is reached, i.e. as much binder is dissolved in the water such that no further binder can be dissolved or the proportion of suspended materials prevails, i.e. the loading of the water with foreign bodies transported therein has risen so sharply that a cleaning effect is no longer achieved when rinsing the foundry sand with the contaminated water.

If mixing of the foundry sand mixture, which is to be prepared, with contaminated cleaning water should be avoided, the foundry sand mixture can be passed through a heat exchanger prior to work step a), through which cleaning water that is contaminated, still hot and separated from the moulding sand in work step b) is channelled in order to pre-heat the foundry sand mixture. This variant is in particular expedient when the cleaning water, obtained in work step b) and possibly reused multiple times beforehand, is contaminated such that further reuse is no longer appropriate.

Even in the case of reusing contaminated cleaning water, it may be necessary to supply fresh cleaning water in work step a) in order to provide the required volume flow of cleaning water.

If necessary, the respectively supplied fresh cleaning water can also be heated by means of an additional heat source, such as for example by means of a flow heater or the like such that the slurry formed in work step a) by mixing with the respectively optionally also pre-heated foundry sand mixture reaches a process temperature which is in the range previously described according to the invention.

After the separating step (work step b)), the moulding sand freed of the binder and the other residues and obtained from the foundry sand mixture can be dried as normal, dedusted if necessary and divided into different grain size classes.

The moulding sand obtained in the manner according to the invention generally has a pH value of 9 to 13. Moulding sands with this pH value can be used in moulding materials intended for the production of casting cores and casting mould parts, to which an inorganic binder is added to bind the moulding sand. If the moulding sand is, however, to be used for a wider range of applications, in particular those where moulding materials should be provided with organic binders, then it is expedient to subject the moulding sand to an additional treatment after the separation of the residues of the inorganic binder provided according to the invention (work step b)), in which treatment its pH is set to values of 5 to 9, preferably 6.5 to 8.5, wherein in particular when the moulding sand obtained in work step b) is supposed to be used for moulding materials with an organic binder, the pH value of the moulding sand is optimally set to 7 to 8.

The moulding sand can be rinsed or wetted with a neutralisation solution to set its pH value. In the event that the moulding sand obtained in work step b) is extremely base, water-diluted acids, such as for example water-diluted hydrochloric acid, sulphuric acid or organic acids (carbonic acid, citric acid) are suitable as the neutralisation solution. Moreover, buffer substances, such as for example carbonate buffer (e.g. sodium hydrogen carbonate) can also be used for neutralisation.

In order to set the pH value, the moulding sand can be mixed with the neutralisation solution. Commercially available stirring apparatuses and the like are available for this purpose.

After setting the pH value, the moulding sand can pass through a rinsing step to remove excess neutralisation solution.

The moulding sand obtained in work step b) and possibly set in regard to its pH value can be subjected to mechanical dewatering. To this end, the moulding sand can be placed for example on a sieve through which drops the liquid residues present in the moulding sand, while the moulding sand grains are held back, or presses, drying belts and the like are used, which are provided for this purpose in the prior art, in order to mechanically drive out moisture from a pourable mass which is comparable with the moulding sand obtained according to the invention. Through the mechanical dewatering, the effort that has to necessarily be expended to dry the moulding sand prior to its reuse as a moulding material can be reduced.

In order to be able to process into a moulding material, the moulding sand obtained according to the invention has to be adequately dried. To this end, the moulding sand obtained in work step b) can be dried by heat application, in which typical drying temperatures are in the range of 80 to 800° C. In the event that the moulding sand has been obtained from a foundry sand mixture consisting of casting cores and casting mould parts, which have been exclusively formed from moulding material containing an inorganic binder, drying temperatures of less than 500° C., in particular 100 to 300° C., are suitable, with temperatures of 200 to 250° C. being particularly practical.

In many foundry operations however, foundry sands accumulate in which in addition to a proportion originating from casting cores or casting mould parts made of moulding materials with inorganic binders, a proportion of fragments or grains of casting cores or moulded parts is also contained, which have been formed from a moulding material, which have been formed from the moulding sand and an inorganic binder and optionally one or a plurality of additives for setting the properties of the moulding material. The residues of the organic binder, which have not been dissolved from the moulding sand grains via the work steps a) and b), carried out according to the invention, of the method according to the invention, can be removed by an annealing treatment, in which the moulding sand present after work step b) is heated so strongly that the organic binder residues burn. To this end, temperatures of 500° C. or more are required, with a typical temperature window for this treatment being 500 to 700° C. In this case where a thermal drying of the moulding sand obtained in work step b) is carried out, this annealing treatment can also be completed during the course of the drying step.

Lastly, the moulding sand obtained by the preparation according to the invention can be subjected to a classification, in which the moulding sand is divided depending on the size of its grains. At the same time, a dedusting of the moulding sand can take place in order to ensure its optimal suitability for the moulding material production.

BRIEF DESCRIPTION OF THE DRAWING

FIG. 1 is a schematic view illustrating an exemplary embodiment of the invention.

DESCRIPTION OF THE INVENTION

The FIGURE schematically shows a work process when preparing a foundry sand mixture, as typically occurs in a casting operation in which from a lightweight metal melt, in particular from an Al or Al alloy melt, cast parts not shown here, such as components for vehicles, can be produced using casting technology in a conventional manner with the aid of casting moulds also not shown here.

A part of the casting moulds here comprises casting cores or moulded parts which are formed from a moulding material mass containing a moulding sand tried and tested in practice for this purpose and an inorganic binder similarly tried and tested, for example water glass. During the production of the respective casting core or moulded part, the binder is activated as usual by heat application in order to ensure the rigid cohesion of the grains of the moulding sand.

Another part of the casting moulds, in contrast, contains casting cores or moulded parts which are formed from a moulding material mass containing a moulding sand tried and tested in practice for this purpose and an organic binder also tried and tested. During the course of the production of the respective casting core or moulded part, a chemical reaction of the binder is caused by adding a reaction medium, for example a gas, by way of which the binder develops its solidifying effect and ensures the rigid cohesion of the grains of the moulding sand.

Upon demoulding the cast parts, the casting cores or the moulded parts are destroyed in a known manner by thermal or mechanical treatments. The moulding material fragments falling away from the cast part in this case and loose moulding material grains form a foundry sand mixture G, in which moulding sand F, hardened inorganic and organic binder and possibly also combustion residues are present which are the result of the combustion or disintegration of parts of the binder present in the respect core or moulded part which occurs as a result of the heat application during the casting operation or the subsequent thermal treatment. Similarly, common additives can also still be present in the foundry sand mixture G which are added in practice to produce moulding material masses provided by cores or moulded parts in order to ensure for example an optimal flow behaviour during the forming of the respective core or moulded part ("core shooting").

In order to recover the moulding sand the foundry sand mixture G, of which a proportion FAB of fragments or grains originate from moulded parts or casting cores made of moulding material with inorganic binder and a proportion FOB of fragments or grains originate from moulded parts or casting cores made of moulding material with organic binder, is fed into the preparation process illustrated in FIG. 1.

In this case, the foundry sand mixture G firstly passes through a grain separation apparatus 1 in which the coarse fragments contained in the foundry sand mixture G are crushed in a manner known per se until only grains and smaller fragments are still present.

The foundry sand mixture G, which is grain-separated and optionally pre-heated in a heat exchanger not illustrated here is introduced into a mixing apparatus 2 with the aid of gravity or for example by pressurised air support.

In order to form a slurry S, in the mixing apparatus 2 the foundry sand mixture G is flown through by or stirred with cleaning water RW by using a fluidised bed or a stirrer, the cleaning water RW being previously, for example, heated in a flow heater. In the slurry S, the inorganic binder residues adhering to the grains dissolve in the cleaning water RW. The slurry S formed in the mixing apparatus 2 is circulated intensively in order to ensure turbulence supporting the removal of the inorganic binder and the other impurities. If necessary, heat is supplied in order to bring the slurry S to a process temperature which is in the optimal range of 80 to 100° C. Excess cleaning water RWK contaminated with inorganic binder residues and other dirt, such as moulding material additives and combustion residues is channelled out of the mixing apparatus 2.

Through the increased process temperature, the mixture of the cleaning water RW with the foundry sand mixture G occurs so intensively that in particular the inorganic binder is substantially completely dissolved within a short time in the cleaning water RW. At the same time, the combustion residues and possibly present additive residues are absorbed by the cleaning water RW from the foundry sand mixture G. The dwell times provided for this purpose of the slurry G in the mixing apparatus 2 are 5 to 60 mins.

From the mixing apparatus 2, the slurry S arrives to a rinsing apparatus 3 in which it is rinsed with cleaning water RW in order to rinse away the inorganic binder residues dissolved in the slurry S from the moulding sand grains and other impurities from the moulding sand grains F of the slurry S.

The rinsing apparatus 3 can be designed as a conventional sieve machine, in which the slurry S is placed onto a sieve and sprayed with cleaning water RW which is applied by means of nozzles arranged above the sieve.

The cleaning water RWK resulting here and contaminated with inorganic binder residues and other dirt is collected and supplied to a pre-cleaning apparatus 4 in which the insoluble inorganic binder residues are separated from the contaminated cleaning water RWK. Similarly, the excess contaminated cleaning water RWK channelled away from the mixing apparatus 2 is supplied to the pre-cleaning apparatus 4. A partial flow RWKV' of the pre-cleaned contaminated cleaning water RWK can be reused by supplying it as cleaning water RW to the mixing apparatus 2. In this case, the total volume flow of the cleaning water RW supplied to the mixing apparatus 2 can be composed of a partial flow of fresh cleaning water RWF and the partial flow RWKV' of the pre-cleaned cleaning water RWK.

Equally, another partial flow RWKV" of the pre-cleaned contaminated cleaning water RWK can be supplied to the rinsing apparatus 3 to rinse the slurry S. The total volume flow of the cleaning water RW supplied to the rinsing apparatus 3 can be composed here of a partial flow of fresh cleaning water RWF and the partial flow RWKV' of the pre-cleaned contaminated cleaning water RWK and a further partial flow RWK of contaminated cleaning water RWK which originates from one or a plurality of the process steps explained below.

Contaminated cleaning water RWKE, which is so significantly soiled that it can no longer carry out a cleaning function, is channelled away from the process and supplied to a separate preparation step.

If the moulding sand F separated in the rinsing apparatus 3 from the slurry S is supposed to be used for the production of moulding material, which comprises an organic binder, then the moulding sand F passes through a treatment apparatus 5, in which it is wetted with an acid-containing neutralisation solution NL in order to set its pH value to a value of 7 to 8 that is optimal for this purpose. Then, the moulding sand F set in regards to its pH value is rinsed in a rinsing apparatus 6 with fresh cleaning water RWF in order to remove excess neutralisation solution NL. The cleaning water RWN accumulating in this case and contaminated with neutralisation solution is collected and disposed of.

The setting of the pH value in the treatment apparatus 5 and the subsequent rinsing in the rinsing apparatus 6 can be skipped if the moulding sand F is exclusively intended for the production of moulding material, which comprises an inorganic binder.

The moulding sand F still loaded with cleaning water RW is transported after rinsing in the rinsing apparatus 3 or the optionally cycled stations "treatment apparatus 5 and rinsing apparatus 6" to a dewatering apparatus 7, in which dewatering is carried out with mechanical means. The dewatering machine 7 can be configured as a sieve machine known for this purpose in the prior art, as a vacuum belt dryer or as a press. Through the mechanic dewatering, the moisture of the moulding sand F is reduced to such an extent that during the subsequent thermal drying notably less energy is needed to reach the required degree of dryness.

The contaminated cleaning water RWK accumulating during mechanical dewatering is for example supplied to the rinsing apparatus 3 as a further partial flow of the cleaning water RW fed in there.

For the thermal drying, the mechanically dewatered moulding sand F is supplied to a drying apparatus 8, which may be a rotary furnace, a belt dryer or the like. In the case where the foundry sand mixture G used comprises a proportion of moulding material fragments and grains containing organic binders or binder residues, the temperature Tw, at which the thermal drying takes place, is set to >500 to 700° C. such that the organic binder residues still adhering to the corresponding proportion of the moulding sand F burn.

In contrast, if the moulding sand F no longer contains any organic binder constituents, then the thermal drying can be carried out at temperatures in the range of 100 to 300° C.

The water vapour accumulating during the thermal drying is collected, condensed and supplied as fresh cleaning water RWF to the process. In this case, the fresh cleaning water RWF obtained during thermal drying for example also forms a partial flow of the cleaning water RW fed into the rinsing apparatus 3.

After the thermal drying in the drying apparatus 8, the moulding sand F passes through a dedusting apparatus 9, in which fine dust FS present in the moulding sand F is separated from the remaining grains of the moulding sand F. The fine dust FS can no longer be used for the casting-related purposes and is therefore deposited in the usual manner or supplied for another use. The dedusting apparatus 9 is for example based on the principle of flow classifying, in which air is used as the separating medium (so-called "wind winnowing"). The air used here can be reused or dissipated to the environment.

The dedusted moulding sand F lastly arrives to a classification apparatus 10 in which the moulding sand F is divided in accordance with at least two moulding sand classes into at least two moulding sand partial quantities Fk, Fm of which the one moulding sand partial quantity Fk comprises the part of the moulding sand F, whose grains do not exceed a certain limit size, while the other moulding sand partial quantity Fm contains the part of the moulding sand F, whose grains have a size which is at least the same as this limit size. The classification step can also be carried out in combination with the dedusting. To this end, fluid basins are normally used in which the moulding sand F is supplied from above, air flows through a sintering plate applied to the base and is set into vibration with the aid of unbalanced motors. At the same time, the fine dust FS is removed by means of the air via a suction apparatus. The grain classes are pulled at the opposing ends of the basin. The finer proportions rise higher and have to overcome a barrier. The coarse proportions do not rise as high and are therefore extracted under a barrier.

The fresh cleaning water RWF required in the preparation process according to the invention and reused contaminated cleaning water RWK or the cleaning water RW possibly formed therefrom through mixing can, if required, be preheated via heat exchangers not shown here, in which exhaust heat released in the process itself according to the invention or in other processes is used in order to heat the respective cleaning water RWF, RWK, RW to a temperature that is optimal for the respective process step.

In FIG. 1 the process flow, which the foundry sand mixture G, the slurry S formed therefrom and the moulding sand F obtained therefrom follow, are represented in continuous lines.

In contrast, the flow of the cleaning water RW, the fresh cleaning water RWF, the contaminated cleaning water RWK, the pre-cleaned contaminated cleaning water RWKV, the neutralisation solution NL and the cleaning water RWN contaminated with neutralisation solution are represented with dashed lines.

New moulding material FA, containing inorganic binder, and new moulding material FO, containing organic binder, is produced from the moulding sand partial quantities FK, FM obtained following the classification, by mixing with organic binder or inorganic binder and the respectively required additives.

From the moulding materials FA, FO, cores or moulded parts can be produced in a conventional manner for casting moulds.

REFERENCE NUMERALS

1 Grain separation apparatus
2 Mixing apparatus
3 Rinsing apparatus
4 Pre-cleaning apparatus
5 Treatment apparatus
6 Rinsing apparatus
7 Mechanical dewatering apparatus
8 Thermal drying apparatus
9 Dedusting apparatus
10 Classification apparatus
F Moulding sand
FA New moulding material containing inorganic binder
FAB Proportion of fragments or grains with inorganic binder in the foundry sand mixture G FK,FM Moulding sand partial quantities
FO New moulding material containing organic binder
FOB Proportion of fragment or grains with inorganic in the foundry sand mixture G
FS Fine dust
G Foundry sand mixture
NL Neutralisation solution
RW Cleaning water
RWKE Contaminated cleaning water RW to be disposed of
RWF Fresh cleaning water
RWK Contaminated cleaning water
RWN Cleaning water RW contaminated with neutralisation solution NL
RWKV' Partial flow of the pre-cleaned contaminated cleaning water
RWKV" Partial flow of the pre-cleaned contaminated cleaning water
S Slurry

The invention claimed is:

1. A method for recovering moulding sand from a foundry sand mixture, which comprises at least one proportion of moulding material fragments or loose moulding material grains, which accumulates when a cast part is demoulded from a casting mould as a result of destruction of casting cores or moulded parts representing the cast part which have been formed from the moulding sand and an inorganic binder and optionally one or a plurality of additives to set properties of the moulding material, wherein the method comprises the work steps:

a) mixing the foundry sand mixture with cleaning water to form a slurry, in order to dissolve inorganic binder residues contained in the foundry sand mixture and optionally present additives from the moulding sand and to rinse them out of the foundry sand mixture, and b) separating the cleaning water contaminated with the inorganic binder residues from the moulding sand contained in the slurry, characterised in that a process temperature of the slurry formed from the cleaning water and the foundry sand mixture (work step a)) is 80 to 200° C. and the slurry is mixed for a dwell time of 5-60 minutes, and the contaminated cleaning water accumulating in work step b) is reused at least once for work step a).

2. The method according to claim 1, characterised in that the process temperature of the slurry is 80 to 120° C.

3. The method according to claim 1, characterised in that the moulding material fragments contained in the foundry sand mixture are mechanically separated into grains prior to mixing with the cleaning water (work step a)).

4. The method according to claim 1, characterised in that the foundry sand mixture passes through a heat exchanger prior to work step a), through which cleaning water that is contaminated, still hot and separated from the moulding sand in work step b) is channelled in order to pre-heat the foundry sand mixture.

5. The method according to claim 1, characterised in that the contaminated cleaning water separated from the moulding sand in work step b) passes through a heat exchanger in which cleaning water flowing in for work step a) is heated.

6. The method according to claim 1, characterised in that reuse of the contaminated cleaning water is repeated until solubility of binder in the water is reached or a proportion of suspended materials contained in the water prevails.

7. The method according to claim 1, characterised in that a pH value of the moulding sand obtained in work step b) is set to a pH value of 5 to 9 by rinsing or wetting with a neutralisation solution.

8. The method according to claim 7, characterised in that a diluted acid is used as the neutralisation solution.

9. The method according to claim 1, characterised in that the moulding sand obtained in work step b) is mechanically dewatered.

10. The method according to claim 1, characterised in that the moulding sand obtained in work step b) is dried at a drying temperature of 80 to 800° C.

11. The method according to claim 1, characterised in that the foundry sand mixture contains a proportion of fragments or grains of casting cores or moulded parts, which have been formed from a moulding material, which has been formed from the moulding sand and an organic binder and optionally one or a plurality of additives to set the properties of the moulding material.

12. The method according to claim 11, characterised in that the moulding sand obtained in work step b) is heated to a temperature of at least 500° C. in order to burn organic binder residues adhering to the moulding sand.

13. The method according to claim 12, characterised in that burning of the organic binder residues takes place during drying of the moulding sand.

14. The method according to claim 1, characterised in that the moulding sand obtained in work step b) is subjected to classification by which the sand is divided into at least two portions, each portion containing particles having sizes falling within a predetermined size range.

* * * * *